US010682737B2

(12) United States Patent
Phann et al.

(10) Patent No.: US 10,682,737 B2
(45) Date of Patent: Jun. 16, 2020

(54) BARRIER DEVICE USED IN THE MANUFACTURE OF A LAPPING PLATE, AND RELATED APPARATUSES AND METHODS OF MAKING

(71) Applicant: Seagate Technology LLC, Fremont, CA (US)

(72) Inventors: Chea Phann, Woodbury, MN (US); Ricky Ray Anderson, Bloomington, MN (US); Kevin Lambert Mayer, Apple Valley, MN (US); Mihaela Ruxandra Baurceanu, Edina, MN (US); Andrew David Habermas, Bloomington, MN (US); Raymond Leroy Moudry, Bloomington, MN (US); Joel William Hoehn, Hudson, WI (US)

(73) Assignee: Seagate Technology LLC, Fremont, CA (US)

( * ) Notice: Subject to any disclaimer, the term of this patent is extended or adjusted under 35 U.S.C. 154(b) by 480 days.

(21) Appl. No.: 15/198,566

(22) Filed: Jun. 30, 2016

(65) Prior Publication Data

US 2018/0001439 A1 Jan. 4, 2018

(51) Int. Cl.

| | |
|---|---|
| ***B24B 37/12*** | (2012.01) |
| ***B24B 37/005*** | (2012.01) |
| ***B24B 53/017*** | (2012.01) |

(52) U.S. Cl.
CPC ..... *B24B 37/12* (2013.01); *B24B 37/005* (2013.01); *B24B 53/017* (2013.01)

(58) Field of Classification Search
None
See application file for complete search history.

(56) References Cited

U.S. PATENT DOCUMENTS

| | | | | |
|---|---|---|---|---|
| 854,592 | A * | 5/1907 | Nelson | A21B 3/137 249/170 |
| 5,876,271 | A * | 3/1999 | Oliver | B24B 37/105 451/41 |
| 6,443,810 | B1 * | 9/2002 | Shih | B24B 37/16 451/285 |
| 6,514,123 | B1 * | 2/2003 | Crevasse | B23Q 3/186 451/28 |
| 6,585,559 | B1 | 7/2003 | Griffin et al. | |
| 6,602,108 | B2 | 8/2003 | Griffin et al. | |
| 6,916,026 | B2 * | 7/2005 | Meza | B23B 31/16 157/16 |
| 6,953,385 | B2 | 10/2005 | Singh, Jr. | |
| 8,944,886 | B2 | 2/2015 | Schwappach et al. | |

* cited by examiner

*Primary Examiner* — Brian D Keller
(74) *Attorney, Agent, or Firm* — Kagan Binder, PLLC

(57) ABSTRACT

The present disclosure includes barrier devices for use in an apparatus used to form lapping plates. The barrier devices can contain liquid on the surface of the lapping plate platen. The present disclosure also involves related methods.

12 Claims, 7 Drawing Sheets

BARRIER DEVICE USED IN THE MANUFACTURE OF A LAPPING PLATE, AND RELATED APPARATUSES AND METHODS OF MAKING

BACKGROUND

The present disclosure relates to lapping plates and methods of making lapping plates that can be used to lap (abrade) one or more bars of sliders.

SUMMARY

The present disclosure includes embodiments of an apparatus for processing a major surface of a lapping plate platen, wherein the apparatus comprises:

a) a rotatable platter configured to secure and physically support the lapping plate platen during processing of the major surface of the lapping plate platen;

b) one or more liquid dispensers configured to dispense one or more liquid treatment compositions onto the major surface of the lapping plate platen;

c) a movable barrier mechanism, wherein the movable barrier mechanism comprises one or more ring segments that can be securely adjusted from an open position to allow one or more liquid treatment compositions to pass through between the barrier mechanism and the outside top perimeter of the lapping plate platen to a closed position so that the one or more elastic ring segments form a barrier that extends above the major surface of the lapping plate platen to substantially contain one or more liquid treatment compositions on the major surface of the lapping plate platen during one or more processing steps of the major surface of the lapping plate platen.

The present disclosure also includes embodiments of a barrier ring assembly configured to be removably retained against a lapping plate platen during processing of a major surface of the lapping plate platen, wherein the ring assembly comprises:

a) a clamp ring having an adjustable inside perimeter that can be retained against an outside perimeter of the lapping plate platen, wherein the clamp ring has an inside perimeter wall, an outside perimeter wall, and slot between at least a portion of the inside perimeter wall and the outside perimeter wall;

b) a ring that can be slidably positioned within the slot so that the slot supports the ring, wherein the ring can be retained against the outside perimeter of the lapping plate platen, wherein when in a closed position the ring extends above the major surface of the lapping plate platen and forms a barrier to substantially contain a liquid treatment composition on the major surface of the lapping plate platen during processing of the major surface of the lapping plate platen; and c) a latch that physically engages the clamp ring and is configured to securely adjust the inside perimeter of the clamp ring from an open and removable position to the closed position that retains the clamp ring and ring to the lapping plate platen to form the barrier to substantially contain a liquid treatment composition on the major surface of the lapping plate platen during processing of the major surface of the lapping plate platen.

The present disclosure also includes embodiments of a method of processing a major surface of a lapping plate platen, wherein the method comprises:

a) positioning a lapping plate platen on a rotatable platter, wherein the rotatable platter is configured to secure and physically support the lapping plate platen during processing of the major surface of the lapping plate platen;

b) actuating a movable barrier mechanism to a closed position to form a barrier that extends above the major surface of the lapping plate platen to substantially contain one or more liquid treatment compositions on the major surface of the lapping plate platen during one or more processing steps of the major surface of the lapping plate platen, wherein the movable barrier mechanism comprises one or more ring segments that can be securely adjusted from the closed position to an open position to allow one or more liquid treatment compositions to pass through between the barrier mechanism and the outside top perimeter of the lapping plate platen; and c) dispensing at least one liquid treatment composition onto the major surface of the lapping plate platen to process the major surface of the lapping plate platen while the movable barrier mechanism is in the closed position.

DETAILED DESCRIPTION

Figure 1:
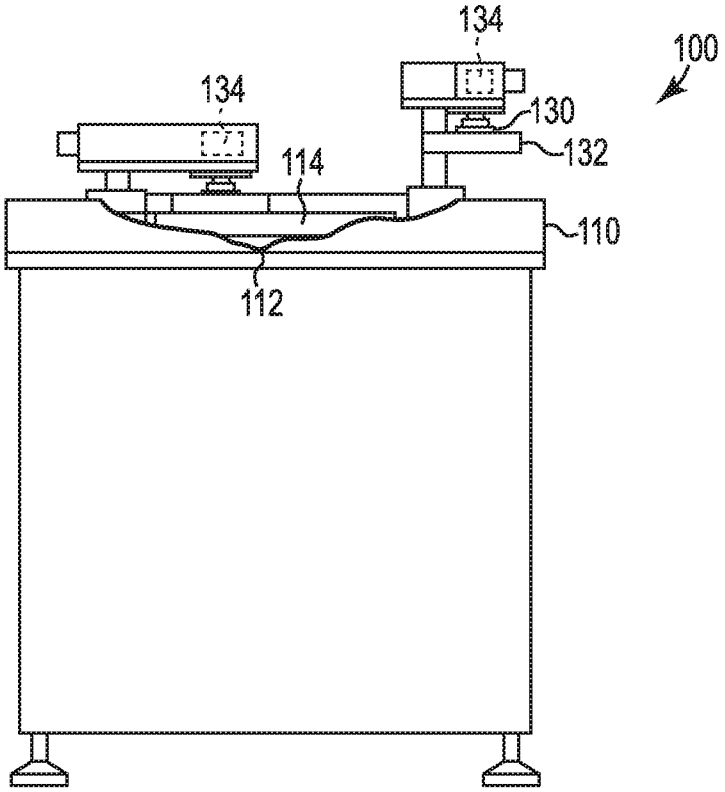
FIG. 1 is a schematic elevation view showing a multi-step apparatus for processing a major surface of a lapping plate platen.

Lapping machines (apparatuses) can be used to perform lapping operations on various substrates such as a bar of sliders. Such lapping machines can use a lapping plate that performs grinding and/or polishing operations on a substrate such as a bar of sliders. Lapping machines can include a rotating lapping plate that defines a lapping surface which can help abrade the surface of a ceramic material such as AlTiC, which is a two phase composite of alumina ($Al_2O_3$) and titanium-carbide (TiC). If desired, a slurry can be applied to the lapping surface to enhance the abrading action as the lapping surface is rotated relative to a slider bar containing a plurality of the sliders held in a pressing engagement against the lapping surface. A lapping plate can be used for a variety of lapping processes such as rough lapping, fine lapping, and kiss lapping. Lapping plates can be constructed such that one, or both, work surfaces of the lapping plate include predetermined amounts of abrasive particles.

Abrasive particles can be made out of one or more materials. In some embodiments, abrasive particles are selected from the group consisting of diamond particles, cubic boron nitride particles, alumina particles, alumina zirconia particles, silicon carbide particles, and combinations thereof. In some embodiments, abrasive particles can be embedded within a ceramic material such as embedded diamond particles (embedded abrasive particles can also be referred to as encapsulated or composite abrasive particles, or even abrasive beads). Embedded abrasive particles are larger in size as compared to bare abrasive particles because the abrasive particles are embedded within ceramic material. For example, in some embodiments, embedded abrasive particles can have an average particle diameter in the range from 10 to 50 micrometers.

A variety of materials and methods can be used to construct the abrasive surface of a lapping plate. For example, the abrasive surface can be formed by embedding abrasive particles into the lapping plate in a process that can be referred to as "charging." Techniques for charging abrasive particles into lapping plates can include hand charging with a tool and charging on an apparatus with various tools.

A variety of apparatuses and devices can be used for processing a lapping plate platen so as to form an abrasive surface on the platen and form a lapping plate. An example of such an apparatus is described in U.S. Pat. No. 6,585,559 (Griffin et al.), wherein the entirety of said patent is incorporated herein by reference. At least with respect to "charging" a platen with a slurry that includes abrasive particles and a liquid, either a multi-step apparatus can be used or a single-step apparatus can be used.

A "multi-step" apparatus, machine, or tool can be configured to perform multiple processes on a platen so as to form a lapping plate. An example of a multi-step apparatus 100 for processing a major surface of a lapping plate platen is described below with respect to FIGS. 1 and 2.

As shown, apparatus 100 includes a base 110. The base 110 can be constructed of rigid or high strength materials. As illustrated in FIG. 1, the base 110 can be mounted on stands, or appropriate support members. As shown, a rotatable platter 112 is rotatably mounted on the base 110. The rotatable platter 112 (or turn table) is configured to secure and physically support the lapping plate platen 114 during processing of the major surface of the lapping plate platen so that it can function as a lapping plate and perform lapping operations. In more detail, the platen 114 includes one or more surfaces 116 (only one shown) that can be used to perform the actual lapping operations. At least the surface 116 of the platen 114 can be an alloy made out of one or more metals. Exemplary metals include at least one of tin, tin alloy, aluminum, copper, combinations of these, and the like.

Platen 114 can have a wide variety of diameters. In some embodiments, platen 114 can have a diameter in the range from 10 to 20 inches.

A main drive motor (not shown) can be attached to the base 110, and can provide the force to rotate the platter 112 during operation of the apparatus 100 (e.g., counterclockwise as indicated by arrow 143). Also, a spindle assembly (not shown) can be coupled to the main drive motor in order to rotate the platter 112.

Figure 2:
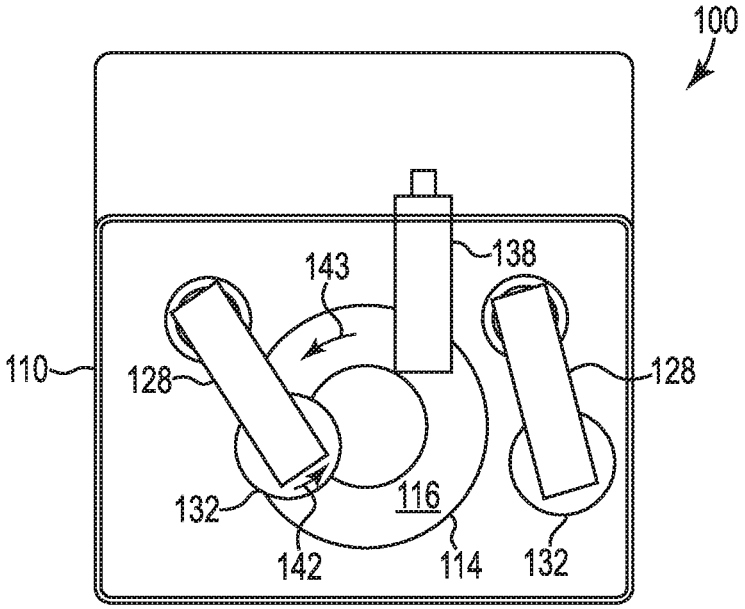
FIG. 2 is a plan view of the apparatus shown in FIG. 1.

As shown, the apparatus 100 includes a pair of arms 128 disposed on the base 110. Although only two arms 128 are illustrated in FIGS. 1 and 2, it should be appreciated that various other configurations are possible. For example, only one arm 128 may be provided, or more than two arms 128 can be provided. As shown, each arm 128 includes a processing head receiving portion 130. A processing head 132 is attached to each processing head receiving portion 130 for performing operations on the surface 116 of the platen 114. Each processing head receiving portion 130 is rotatably mounted to its respective arm 128 so that processing head 132 is capable of rotation. Each arm 128 further includes a spindle motor 134 that controls rotation of the processing head receiving portion 130. In some embodiments, the processing head receiving portion 130 can be configured with a quick change arrangement that can readily accept a variety of texturizing, washing, charging, and other processing heads 132. The arms 128 are used (in conjunction with the heads 132) to process (e.g., texturizing, washing, and charging operations) the platen 114 in preparation for lapping operations. The processing heads 132 can be configured based on a given processing step.

An actuator (not shown) can be coupled to each arm 128. The actuators can function to place the processing heads 132 in desired alignment with the surface 116 of the platen 114. Accordingly, the actuators are capable of placing the arms 128 in various operating positions. As shown in FIG. 2, the head receiving portion 130 can be placed in a first position wherein at least a portion of the processing head 132 overlies a portion of the surface 116 of the platen 114 when the processing head 132 is in contact with the surface 116. A second position is also shown wherein another processing head 132 has been raised and placed out of alignment with the platen 114 (the processing head 132 is completely outside the perimeter of surface 116). It can be appreciated that the actuators can also be capable of placing the processing heads 132 in any intermediate positions between the two positions illustrated in FIG. 2. By virtue of its mode of operation, the actuators can be controllable for placing the heads 132 in contact with the surface 116 of the platen 114. In some embodiments, one or more predetermined weights (not shown) can be coupled with each arm 128 and head 132 so that a predetermined amount of pressure is applied downward on the head 132 and, therefore, the surface 116 of platen 114 during processing. Alternatively, pneumatic pressure can be used to apply downward pressure on head 132.

An apparatus according to the present disclosure can include one or more liquid dispensers configured to dispense one or more liquid treatment compositions onto the major surface 116 of the lapping plate platen 114. As shown, apparatus 100 includes a dispensing unit 138 mounted on the base 110. The dispensing unit 138 can be configured to dispense controlled quantities of a liquid treatment composition onto the surface 116 of the platen 114. The liquid treatment composition dispensed on the platen 114 can be for example in the form of a liquid containing predetermined concentrations of abrasive particles. The dispensing unit 138 can be configured to dispense a liquid treatment composition in various manners depending on the specific operation being performed. For example, the dispensing unit 138 can be configured to dispense a liquid treatment composition in a drip fashion onto the surface 116. The dispensing unit 138 can be further controlled to either dispense or not dispense a liquid treatment composition for predetermined intervals of time depending on the specific protocol of the operation being performed.

A "single-step" apparatus can be configured to perform only a charging process to embed abrasive particles into the surface of a platen so as to form a lapping plate. For example, such an apparatus may be substantially similar to apparatus 100 with the exception of having only one arm 128 and one processing head 132.

An example of "charging" the surface 116 with a slurry of diamond particles to form a charged lapping surface is described herein below in connection with apparatus 100. "Charging" refers to a process of embedding abrasive particles from a suspension in a liquid into the surface 116 of platen 114. Charging can be performed using a processing head 132 in combination with a diamond abrasive charging slurry dispensed from dispensing unit 138. Specifically, as discussed above, pneumatics or predetermined weights (not shown) can be coupled with each arm 128 and head 132 so that the head 132 applies a predetermined amount of pressure to the surface 116 of platen 114 to help embed the diamond particles contained in the slurry into the lapping surface 116. In addition to rotating platter 112 and platen 114 as indicated by arrow 143, a processing head 132 can be rotated as indicated by arrow 142 for a period of time to embed a desired amount of abrasive particles into the surface 116. It is noted that rotating platter 112 and head 132 are not restricted to a particular direction of rotation.

Charging can be performed under a variety of rotatable platter 112 speeds and for a variety of time periods. Charging can be performed for a time period to produce a dense and even coverage of abrasive particles in surface 116. For example, charging can be performed for a time period in the range from 5 to 120 minutes. The rotational speed of the rotatable platter can be in a range from about 10 to 60 rpms to allow the abrasive particles to become fully embedded within the surface 116. The rotational speed of the processing head 132 can also be in a range from about 10 to 60 rpm.

In some embodiments, charging can be performed under constant conditions. Accordingly, rotational velocity of the charging head 132, pressure, and slurry concentration can be accurately controlled.

Figure 3:
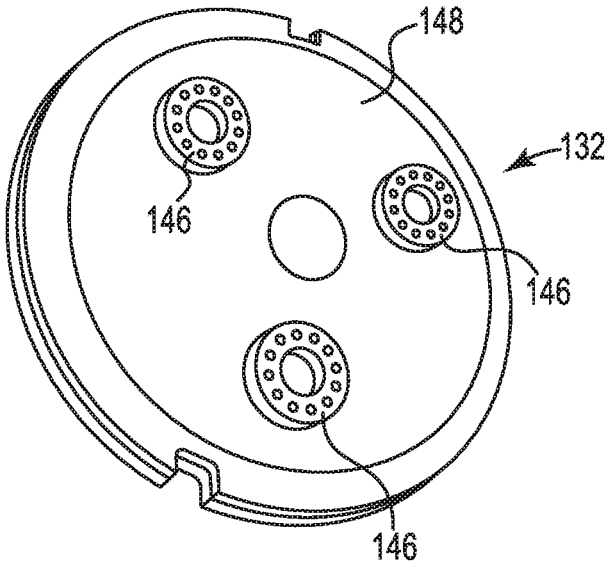
FIG. 3 is a perspective, underside view of a tool.

An example of a charging head 132 is further illustrated in FIG. 3. Head 132 has a lower surface 148 that faces surface 116 during charging. As shown, lower surface 148 has three raised, puck-shaped charging rings 146 mounted to the lower surface 148. Rings 146 can be made out of a variety of materials such as zirconia toughened alumina (ZTA), or alumina. Also, any desired number and shape of charging rings 146 can be used.

Figure 4:
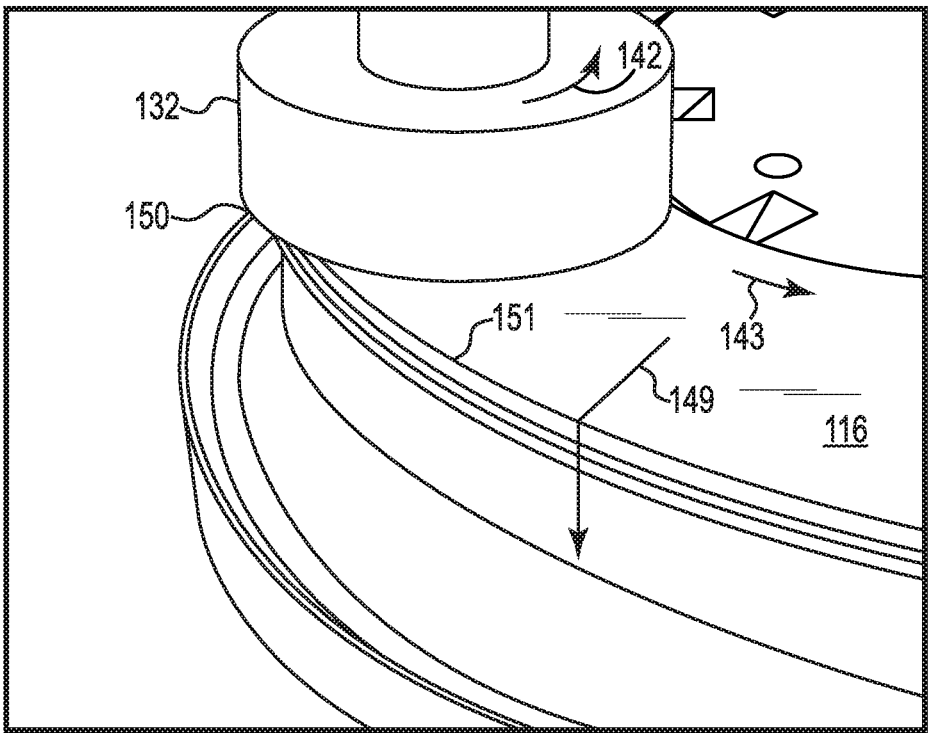
FIG. 4 is a partial, perspective view of a tool used to process a lapping plate platen.

In one embodiment, as shown in FIG. 4, head 132 is lowered relative to surface 116 so that head 132 is in contact with surface 116 while having a prescribed amount of weight forcing rings 146 into contact with surface 116 under a prescribed amount of pressure. During charging, the head 132 can rotate counter-clockwise as indicated by arrow 142, and the platen 114/and rotatable platter 112 can rotate counter-clockwise as indicated by arrow 143. A slurry containing abrasive particles such as diamond particles can be discharged onto surface 116 via one or more dispensing units such as dispensing unit 138 discussed above. As the slurry contacts the surface 116, rings such as 146 drive the diamond particles into surface 116 so that the particles become fixed to the surface 116 so as to form an abrasive surface for lapping operations. As shown in FIG. 3, rings 146 are positioned a distance inward from the perimeter of head 132. Accordingly, as shown in FIG. 4, as head 132 rotates the perimeter edge 150 of head 132 can go beyond the perimeter edge 151 of platen 114 so that the rings 146 can contact the outer regions of surface 116 and the entire surface 116 can be charged with abrasive particles.

As shown by arrow 149 in FIG. 4, unused slurry may be discharged from surface 116 over edge 151 due to one or more of centrifugal force of rotating platen 114, and rotating rings 146. Slurry such as diamond particle slurry for charging can be relatively quite expensive. There is a desire to reduce the amount of slurry, especially a slurry used in charging such as a diamond slurry, that is discharged over the edge 151 of platen 114 and, oftentimes into a waste collection system. It may also be desirable to reduce the amount of one or more additional treatment compositions such as compositions used to oxidize surface 116.

Embodiments of the present disclosure include a barrier device to substantially contain one or more liquid treatment compositions on the major surface of the lapping plate platen during one or more processing steps (e.g., charging) of the major surface of the lapping plate platen. A barrier device can cause a treatment composition to pool on the surface of the platen so that the treatment composition is available for use by a head such as head 132. The contained liquid treatment composition (e.g., diamond slurry) can be distributed radially due to platen rotation, which can help cause the liquid to build up moving from an outer perimeter of the platen towards an inner perimeter. Movement of the charging rings can also help distribute the liquid treatment composition. In some embodiments, a spacer can optionally be used between the perimeter of the platen and the barrier so as to permit the perimeter of a processing head to extend beyond the perimeter of the platen and facilitate processing the entire surface of the platen while at the same time containing the treatment composition on the surface of the platen so that it does leak into a waste treatment system.

In some embodiments, a barrier device can be manually coupled to a lapping plate platen so that the barrier can contain one or more liquid treatment compositions on the major surface of the lapping plate platen during one or more processing steps (e.g., charging) of the major surface of the lapping plate platen. In some embodiments, a barrier device can be optionally or alternatively incorporated into an apparatus (e.g., apparatus 100) for processing a major surface of a lapping plate platen, where the barrier can be configured to automatically couple to a lapping plate platen so that the barrier can contain one or more liquid treatment compositions on the major surface of the lapping plate platen during one or more processing steps (e.g., charging) of the major surface of the lapping plate platen.

An example of manually coupling a barrier to a lapping plate platen is illustrated in connection with FIGS. 5A-5C. As shown in FIG. 5C, a barrier device is in the form of a ring assembly 500 configured to be removably retained against a lapping plate platen 514 during processing of a major surface 516 of the lapping plate platen 514. As shown in FIG. 5B, the ring assembly 500 includes a clamp ring 505 having an adjustable inside perimeter 506 that can be retained against an outside perimeter 517 of the lapping plate platen 514. The clamp ring 505 can have an inside perimeter wall 508, an outside perimeter wall 507, and slot 509 between at least a portion of the inside perimeter wall 508 and the outside perimeter wall 507.

Figure 5A:
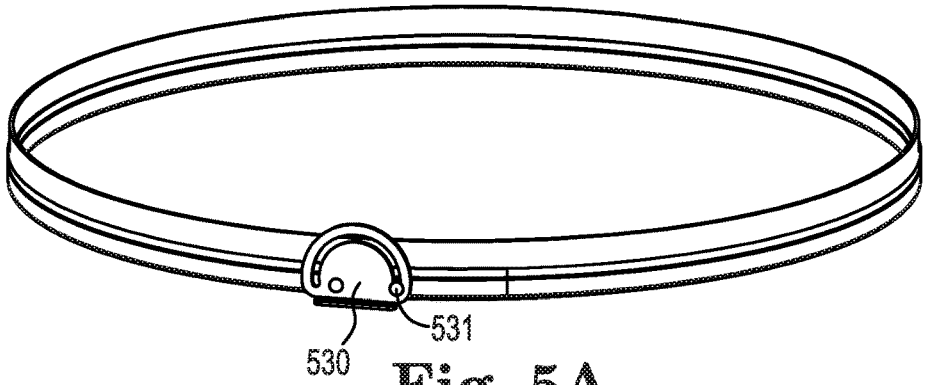
FIG. 5A is a perspective view of one embodiment of a barrier device according to the present disclosure in the open position.
Figure 5B:
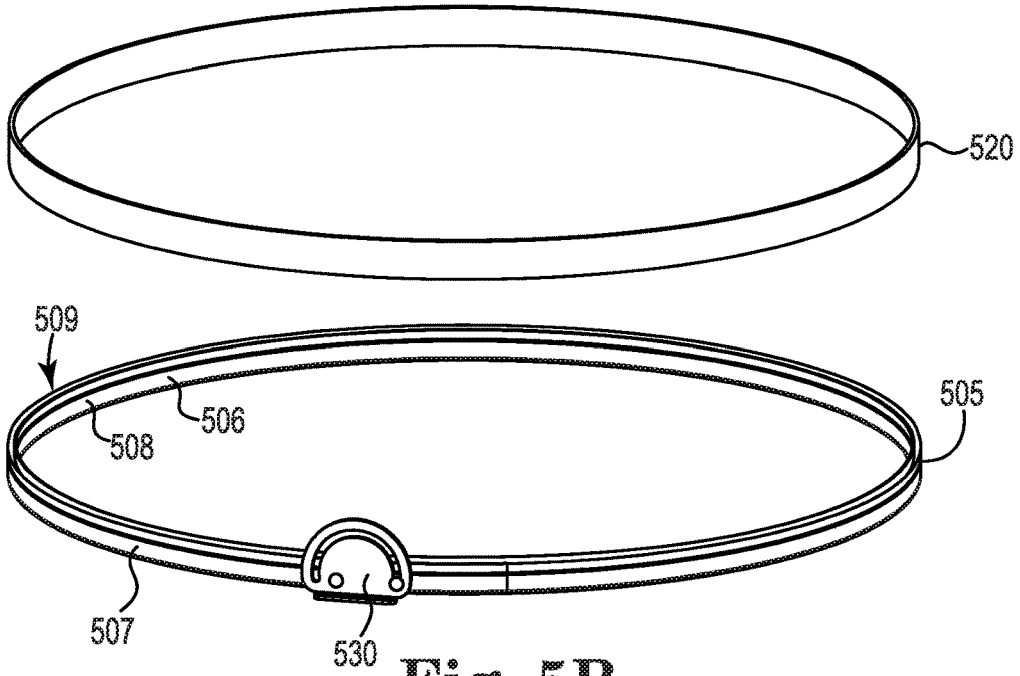
FIG. 5B is an exploded view of the device in FIG. 5A.
Figure 5C:
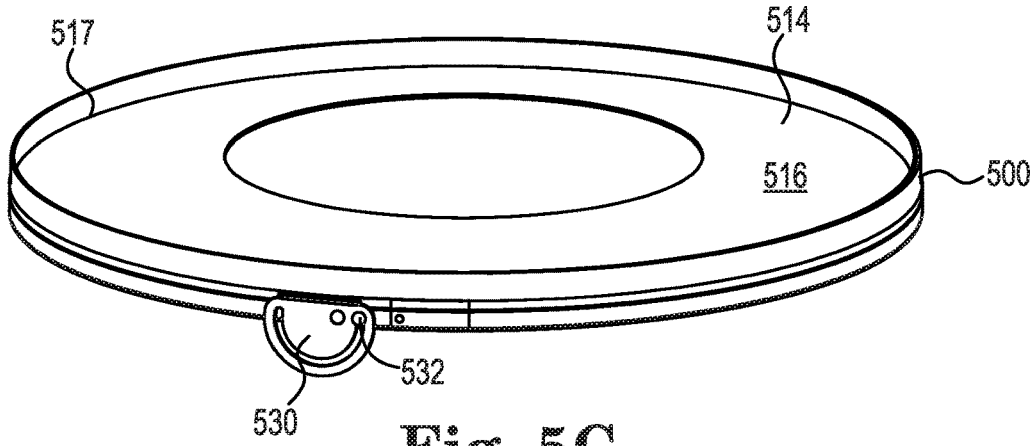
FIG. 5C is a perspective view of the barrier device in FIG. 5A in the closed position.

As also shown in FIGS. 5A-5C, a ring 520 can be slidably positioned within the slot 509 so that the slot 509 supports the ring 520. In some embodiments, ring 520 can be an elastic ring. The elastic ring 520 can be retained against the outside perimeter 517 of the lapping plate platen 514. As shown in FIG. 5C, when the ring assembly 500 is in a closed position the elastic ring 520 extends above the major surface 516 of the lapping plate platen 514 and forms a barrier to substantially contain a liquid treatment composition (not shown) on the major surface 516 of the lapping plate platen 514 during processing of the major surface 516 of the lapping plate platen 514.

An elastic ring can have a variety of heights and thicknesses. In some embodiments, the elastic ring can have a height of at least 0.5 inches, at least 1 inch, or even 1.5 inches. In some embodiments, the elastic ring can extend above the major surface of the lapping plate platen at least 0.1 inches, at least 0.25 inches, or even at least 1 inch. An elastic ring can have a thickness such that it is rigid enough to remain substantially perpendicular to the major surface of the lapping plate platen and form a barrier to liquid treatment compositions used during processing.

An elastic ring can have a variety of diameters and can be selected based on the diameter of the lapping plate platen. In some embodiments, the elastic ring can have a diameter of 10 inches or more, 12 inches or more, 15 inches or more, or even 20 inches or more.

An elastic ring can be made out of one or more elastic materials. In some embodiments, an elastic ring can be made out of rubber.

As shown, assembly 500 also includes a latch 530 that physically engages the clamp ring 505 and is configured to securely adjust the inside perimeter wall 508 of the clamp ring 505 from an open and removable position 531 to the closed position 532 that retains the clamp ring 505 and elastic ring 520 to the lapping plate platen 514 to form the barrier to substantially contain a liquid treatment composition on the major surface of the lapping plate platen during processing of the major surface of the lapping plate platen.

In some embodiments, a continuous elastic band can be manually coupled to lapping plate platen without a metal band. A band having a diameter less than the lapping plate platen can be stretched and placed around the outside perimeter of a lapping plate platen so that a portion of the band sticks above the major surface of the lapping plate platen during processing to contain a liquid treatment composition (e.g., abrasive slurry).

As mentioned above, the barrier can be configured to automatically couple to a lapping plate platen so that the barrier can contain one or more liquid treatment compositions on the major surface of the lapping plate platen during one or more processing steps (e.g., charging) of the major surface of the lapping plate platen. An embodiment of an automated barrier is described below in connection with FIGS. 6A-6C.

Figure 6A:
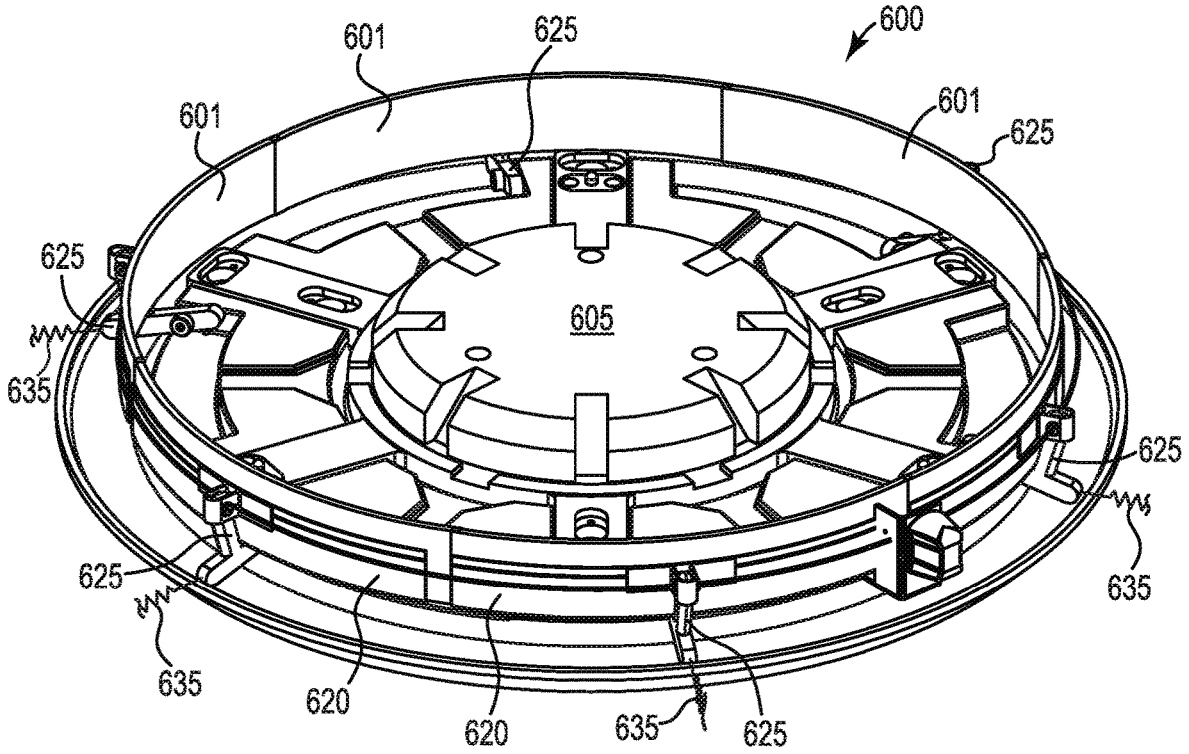
FIG. 6A is a perspective view of a second embodiment of a barrier device according to the present disclosure in the open position.
Figure 6B:
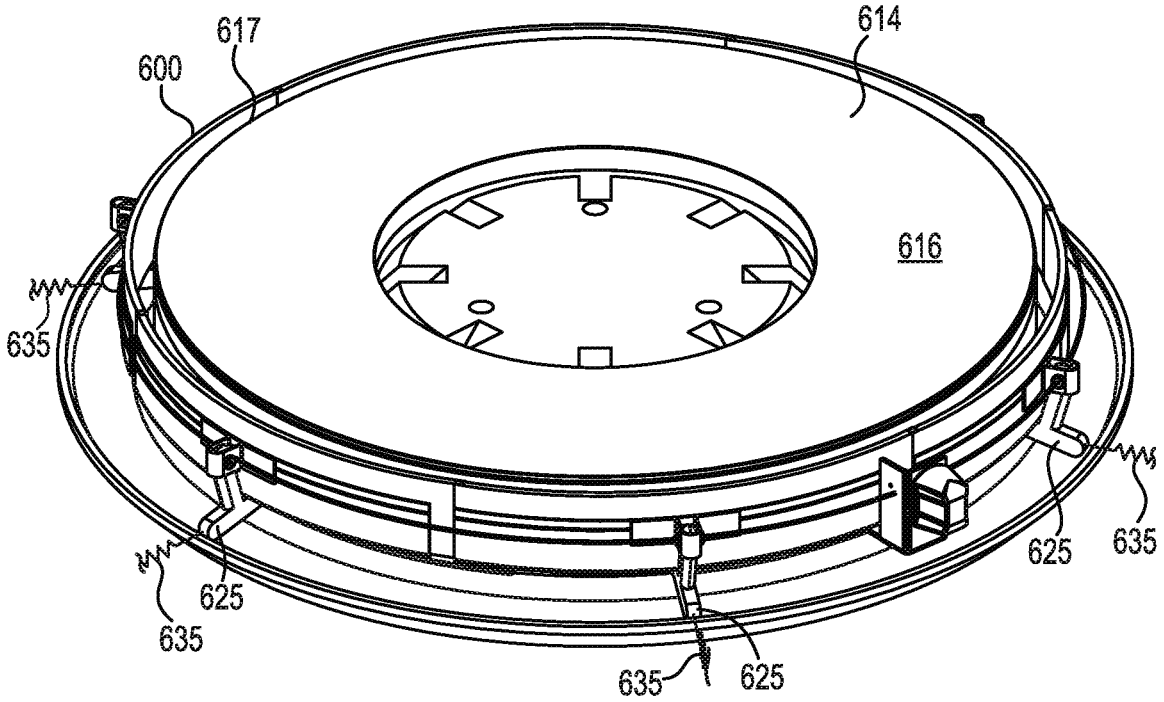
FIG. 6B is a perspective view of the barrier device in FIG. 6A with a lapping plate platen included.
Figure 6C:
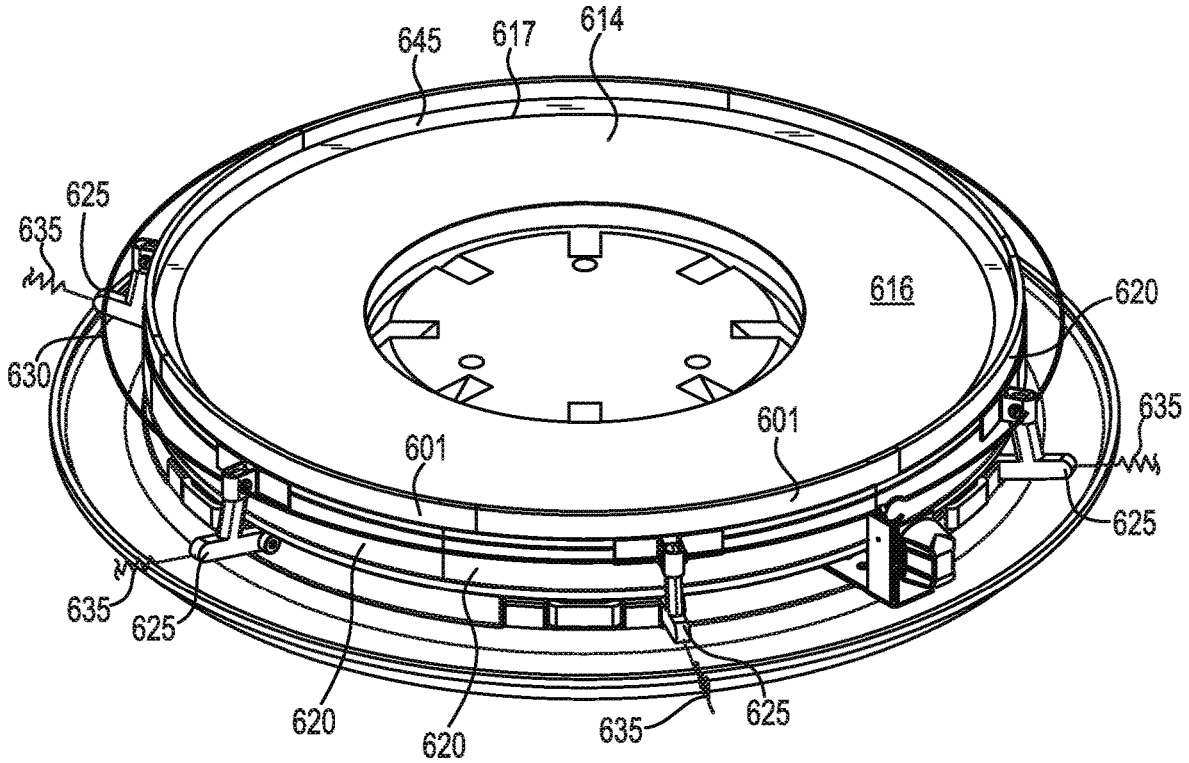
FIG. 6C is a perspective view of the barrier device in FIG. 6B in the closed position.

FIGS. 6A-6C show a portion of a multi-step apparatus for processing a major surface of a lapping plate platen, that includes a movable barrier mechanism 600. FIG. 6A shows a movable barrier mechanism 600 surrounding a pedestal 605 without a lapping plate platen positioned therein.

As shown in FIG. 6A, a movable barrier mechanism 600 can include one or more ring segments 601 (six shown). In some embodiments, one or more ring segments 601 can include one or more elastic ring segments 601. The elastic ring segments 601 can be securely adjusted from an open position (as shown in FIG. 6B) to allow one or more liquid treatment compositions to pass through between the barrier mechanism 600 and the outside top perimeter 617 of the lapping plate platen 614 to a closed position (as shown in FIG. 6C) so that the one or more elastic ring segments 601 form a barrier that extends above the major surface 616 of the lapping plate platen 614 to substantially contain one or more liquid treatment compositions (not shown) on the major surface 616 of the lapping plate platen 614 during one or more processing steps of the major surface 616 of the lapping plate platen 614.

As mentioned, one or more elastic ring segments can be used. Some embodiments include three or more elastic ring segments, four or more elastic ring segments, five or more elastic ring segments, six or more elastic ring segments, etc.

An elastic ring can have a variety of heights and thicknesses. In some embodiments, the elastic ring can have a height of at least 0.5 inches, at least 1 inch, or even 1.5 inches. In some embodiments, the elastic ring can extend above the major surface of the lapping plate platen at least 0.1 inches, at least 0.25 inches, or even at least 1 inch. An elastic ring can have a thickness such that it is rigid enough to remain substantially perpendicular to the major surface of the lapping plate platen and form a barrier to liquid treatment compositions used during processing.

An elastic ring can have a variety of diameters and can be selected based on the diameter of the lapping plate platen. In some embodiments, the elastic ring can have a diameter of 10 inches or more, 12 inches or more, 15 inches or more, or even 20 inches or more.

An elastic ring can be made out of one or more elastic materials. In some embodiments, an elastic ring can be made out of rubber.

A movable barrier mechanism can also include three or more rigid segments that support and move the one or more elastic ring segments from an open position to allow one or more liquid treatment compositions to pass through between the barrier mechanism and the outside top perimeter of the lapping plate platen to a closed position so that the one or more elastic ring segments form a barrier that extends above the major surface of the lapping plate platen to substantially contain one or more liquid treatment compositions on the major surface of the lapping plate platen during one or more processing steps of the major surface of the lapping plate platen. As shown in FIG. 6A, movable barrier mechanism 600 includes six rigid segments 620 that support and help move the six elastic ring segments 601 from the closed position shown in FIG. 6C to the open position shown in FIG. 6B. Each of the rigid segments 620 are a u-shaped channel to receive and support the elastic ring segments 601 in a secure manner. The rigid segments can be made out of a variety of rigid materials that can secure the elastic segments, withstand actuation forces, and the processing environment. In some embodiments, the segments 620 can be made out of material including plastic, metal, and the like.

The movable barrier mechanism 600 can include a variety of mechanisms to automate the opening and closing of the barrier mechanism relative to a lapping plate platen. As shown in FIGS. 6A-6C, barrier mechanism 600 includes six cam levers 625 that are each coupled to a corresponding rigid segment 620. Each cam lever 625 is coupled to a spring 635 so that each cam lever 625 is spring loaded to cause the corresponding rigid segment 620 to force the corresponding elastic ring segment 601 to the open position as shown in FIG. 6B in biased manner (i.e., without any counter force applied). As shown in FIG. 6C, the movable barrier mechanism 600 also includes a wire mechanism having a wire 630 coupled to each of the cam levers 625. The wire mechanism is configured to move the wire 630, thereby moving each of the cam levers 625 against the force of the spring and to the closed position as shown in FIG. 6C. As can be seen in the closed position, the elastic ring segments 601 are retained against the outside perimeter 617 of the lapping plate platen 614 when the barrier mechanism 600 is in the closed position.

In some embodiments, the apparatus shown in FIGS. 6A-6C can optionally include a spacer element 645 positioned between the outside perimeter 617 of the lapping plate platen 614 and the elastic ring segments 601 when in the closed position. With reference to FIG. 4, a spacer 645 may be desirable in some embodiments so that the outside perimeter of a processing head 132 can extend beyond the outside perimeter 617 of the platen 614 and facilitate processing the entire surface of the platen while at the same time containing the treatment composition on the surface of the platen. This may be especially desirable if the rings 146 do not cause the bottom of head 132 to be offset above the top of the elastic ring segments 601.

To charge a major surface 616 of the lapping plate platen 614 with an abrasive slurry, a lapping plate platen 614 can be positioned on a rotatable platter or pedestal 605. The rotatable platter 605 can be configured to secure and physically support the lapping plate platen 614 during processing of the major surface 616 of the lapping plate platen 614. As shown in FIG. 6C, during charging, the movable barrier mechanism 600 can be actuated to a closed position using wire 630 to form a barrier that extends above the major surface 616 of the lapping plate platen 614 to substantially contain one or more liquid treatment compositions (not shown) on the major surface of the lapping plate platen 614 during charging of the major surface 616 of the lapping plate platen 614. In the closed position, the rigid segments 620 and elastic ring segments 601 are tightly retained against the outside perimeter 617 of the platen 614 to contain the abrasive slurry on the surface 616 during charging.

As shown in FIG. 6B, during rinsing and/or one or more other liquid processing protocols, the wire 630 can be released so that the springs (not shown) force each of the cam levers outwards, thereby causing an open space to form between the outer perimeter 617 of platen 614 and the rigid segments 620 and elastic ring segments 601 so that liquid can pass there between and to a drain.

What is claimed is:

1. An apparatus for processing a major surface of a lapping plate platen, wherein the apparatus comprises:

a) a rotatable platter configured to secure and physically support the lapping plate platen during processing of the major surface of the lapping plate platen;

b) one or more liquid dispensers configured to dispense one or more liquid treatment compositions onto the major surface of the lapping plate platen;

c) a movable barrier mechanism, wherein the movable barrier mechanism comprises one or more ring segments, wherein the barrier mechanism is positioned relative to the rotatable platter such that when a lapping plate platen is positioned on the rotatable platter the one or more ring segments can be securely adjusted from an open position to allow one or more liquid treatment compositions to pass through between the barrier mechanism and the outside top perimeter of the lapping plate platen to a closed position so that the one or more ring segments form a barrier that extends above the major surface of the lapping plate platen to substantially contain one or more liquid treatment compositions on the major surface of the lapping plate platen during one or more processing steps of the major surface of the lapping plate platen, wherein barrier mechanism is configured to automatically open to the open position and close to the closed position during the one or more processing steps, wherein the one or more ring segments comprise a plurality of ring segments, wherein each of the plurality of ring segments comprises two ends, wherein the closed position is defined by one end of a first ring segment of the plurality of ring segments abutting one end of a second ring segment of the plurality of ring segments.

2. The apparatus of claim 1, wherein the one or more ring segments comprise one or more elastic ring segments.

3. The apparatus of claim 1, wherein the movable barrier mechanism further comprises three or more rigid segments that that support and move the one or more ring segments from an open position to allow one or more liquid treatment compositions to pass through between the barrier mechanism and the outside top perimeter of the lapping plate platen to a closed position so that the one or more ring segments form a barrier that extends above the major surface of the lapping plate platen to substantially contain one or more liquid treatment compositions on the major surface of the lapping plate platen during one or more processing steps of the major surface of the lapping plate platen.

4. The apparatus of claim 3, wherein each of the three or more rigid segments comprise a u-shaped channel to receive and support the one or more ring segments in a secure manner, wherein the one or more ring segments are elastic ring segments.

5. The apparatus of claim 3, wherein the three or more rigid segments comprise metal.

6. The apparatus of claim 3, wherein the movable barrier mechanism further comprises three or more cam levers, wherein each cam lever is coupled to a corresponding rigid segment, and wherein each cam lever is coupled to a spring so that the cam lever is spring loaded to cause the corresponding rigid segment to move a corresponding ring segment to the open position.

7. The apparatus of claim 6, wherein the movable barrier mechanism further comprises a wire mechanism coupled to each of the cam levers, wherein the wire mechanism comprises a wire and is configured to move each of the cam levers against the spring load and to the closed position.

8. The apparatus of claim 1, wherein the one or more ring segments are retained against the outside perimeter of the lapping plate platen when in the closed position.

9. The apparatus of claim 1, further comprising a spacer element positioned between the outside perimeter of the lapping plate platen and the one or more ring segments when in the closed position so that the one or more ring segments form a barrier that extends above the major surface of the lapping plate platen to substantially contain one or more liquid treatment compositions on the spacer element and the major surface of the lapping plate platen during one or more processing steps of the major surface of the lapping plate platen.

10. The apparatus of claim 1, further comprising an actuatable arm coupled to the apparatus, wherein the actuatable arm is rotatably coupled to a processing head, wherein the processing head is adapted to force abrasive particles into the major surface of the lapping plate platen, and wherein the actuatable arm is adapted to be selectively position the processing head relative to the major surface of the lapping plate platen.

11. The apparatus of claim 10, wherein at least one of the one or more liquid dispensers is in fluid communication with an abrasive slurry.

12. The apparatus of claim 1, further comprising a motor coupled to the rotatable platter to drive the rotatable platter during the one or more processing steps of the major surface of the lapping plate platen.

* * * * *